US011623836B2

(12) United States Patent
Lawrence et al.

(10) Patent No.: US 11,623,836 B2
(45) Date of Patent: Apr. 11, 2023

(54) GRIT ROLLER FEEDER ROLLERS FOR STICKY MEDIA

(71) Applicant: Toshiba America Business Solutions, Inc., Lake Forest, CA (US)

(72) Inventors: Michael W Lawrence, Lexington, KY (US); Brad W Towe, Versailles, KY (US); William M. Connors, Lexington, KY (US)

(73) Assignee: Toshiba America Business Solutions, Inc., Lake Forest, CA (US)

( * ) Notice: Subject to any disclaimer, the term of this patent is extended or adjusted under 35 U.S.C. 154(b) by 0 days.

(21) Appl. No.: 17/551,958

(22) Filed: Dec. 15, 2021

(65) Prior Publication Data

US 2022/0185610 A1 Jun. 16, 2022

Related U.S. Application Data

(60) Provisional application No. 63/239,944, filed on Sep. 2, 2021, provisional application No. 63/125,543, filed on Dec. 15, 2020.

(51) Int. Cl.

| | |
|---|---|
| ***B65H 27/00*** | (2006.01) |
| ***B65C 9/18*** | (2006.01) |
| ***B41J 15/04*** | (2006.01) |
| ***B41J 15/16*** | (2006.01) |
| ***B65C 9/42*** | (2006.01) |

(52) U.S. Cl.

CPC ..... *B65H 27/00* (2013.01); *B41J 15/04* (2013.01); *B41J 15/16* (2013.01); *B65C 9/18* (2013.01); *B65C 9/183* (2013.01); *B65C 9/42* (2013.01); *B65H 2404/11* (2013.01); *B65H 2404/14* (2013.01); *B65H 2701/192* (2013.01)

(58) Field of Classification Search

CPC .. B65H 3/0615; B65H 27/00; B65H 2404/11; B65H 2701/192; B65C 9/18; B65C 9/183

See application file for complete search history.

(56) References Cited

U.S. PATENT DOCUMENTS 5,988,635 A * 11/1999 Ohshima ..... B65H 5/06 271/274
6,554,270 B2 * 4/2003 Yamamoto ..... B65H 3/0615 271/121
7,121,311 B2 * 10/2006 VanderSyde ..... B65C 9/1826 156/387
9,653,006 B2 * 5/2017 Kian ..... G09F 3/02

FOREIGN PATENT DOCUMENTS

GB 2328427 A * 2/1999

OTHER PUBLICATIONS

General Magnaplate Corp., PLASMADIZE Marketing Brochure, Sep. 30, 2020.

GRAPHTEC FC7000-UM-151 User Manual, May 10, 2005, United States, pp. 1, 17.

* cited by examiner

*Primary Examiner* — Howard J Sanders

(74) *Attorney, Agent, or Firm* — Ulmer & Berne LLP

(57) ABSTRACT

A system and method for advancing sticky media through printers includes one or more feed rollers comprised of a grit roller. The grit roller contacts an adhesive side of liner-less label stock removed from a roll or stack for printing. The grit roller works cooperatively with an opposing, counter-rotating roller to remove the label stock from the roll and feed it to a printer.

6 Claims, 3 Drawing Sheets

GRIT ROLLER FEEDER ROLLERS FOR STICKY MEDIA

TECHNICAL FIELD OF THE INVENTION

This application relates generally to label printing. The application relates more particularly to printing labels on media having an exposed adhesive surface.

BACKGROUND OF THE INVENTION

Feed rollers functions to move print media through a printer. A roller typically operates cooperatively with an axially aligned, counter rotating roller.

A pick roller, sometimes referred to as a pick tire, is a particular type of feed roller that functions to commence movement of media, such as paper, in a printer. A pick roller or tire is used, for example, to remove a top sheet of paper from a stack to feed it to the printer for printing. Standard paper pick rollers are typically solid, horizontally grooved or vertically grooved.

Surfaces of current feed rollers are made of pliable gripping materials such as rubber, so as to grip paper to move it forward.

BRIEF DESCRIPTION OF THE DRAWINGS

Various embodiments will become better understood with regard to the following description, appended claims and accompanying drawings wherein:

DETAILED DESCRIPTION OF THE INVENTION

Figure 1:
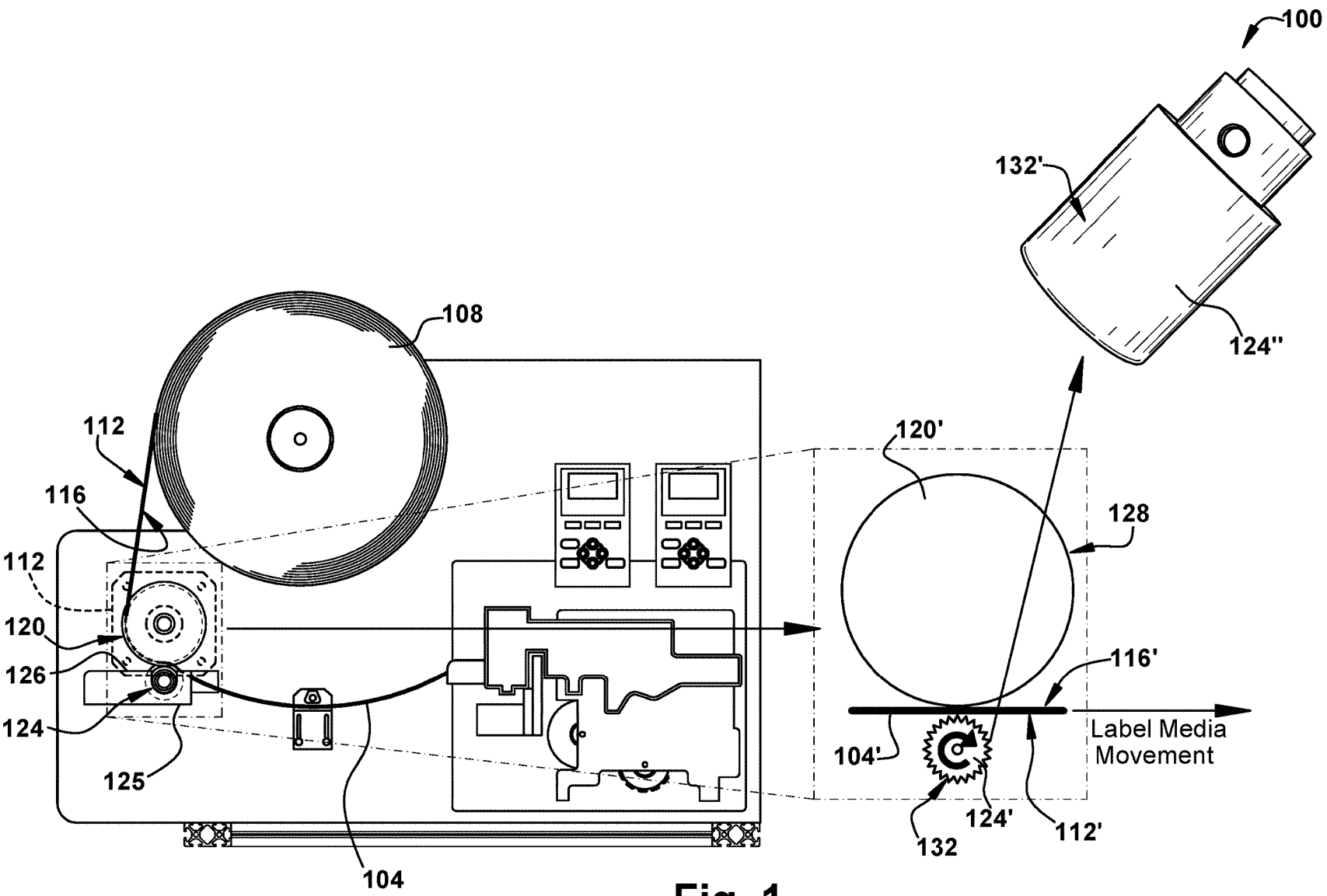
FIG. 1 an example embodiment of an inline printer for printing on label stock with an exposed adhesive side removed from roll.

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

Printers can print on media other than regular paper. These include envelopes and labels. Label sheets include a print side and an adhesive side. The adhesive side is covered by a removable liner. The liner is removed after printing so that the labels may be affixed to envelopes, packages or other objects. Commercial package mailing systems may use a label specific printer, such as an in-line printer that prints a series of labels from a reel of label stock. The label stock includes a lining over its adhesive side and the lining is stripped away after printing.

Liner-Less label stock is a relatively new development in packaging and shipping. Labels can be comprised of a single sheet with a designated area on the front side for information, such as a shipping address. There is no liner paper on the adhesive side, nor any plastic sleeve for the label. Waste is thus eliminated.

More recently, duplex printing, which is printing on both sides of a label, is used. Duplex printing facilitates providing information, such as item lists or return address labeling, on un-gummed or non-adhesive areas of an adhesive side of the label. The shipping label can be scored such that, when pulled away from a package, the un-gummed, printed portion is revealed. In-line printing involves use of label stock removed from a label roll. A series of labels are printed and cut sequentially.

Standard feeder rollers function well for regular paper stock, as well as label stock having a liner covering the adhesive side during printing. More recently, in-line printing on liner-less label stock has been introduced. An example of in-line print of liner-less labels can be found in U.S. Pat. No. 8,109,537, entitled "Linerless Packing and Shipping Label System," the contents of which are incorporated herein by reference.

Conventional rollers have problems when used in connection with label printers fed with stock that is sticky. Current feed rollers, made of materials such as rubber, wear, get dirty and accumulates adhesive. This causes them to commence grabbing stock rather than moving it forward as intended.

Example embodiments herein uses a grit roller as a feed roller. Grit rollers are used in applications such as the automotive industry. These grit rollers can be used in brake test benches to test the power or brake systems of the car. Grit rollers can be used in applications such as in conveyor belt drive systems. In such applications, grit rollers are pressed against a conveyer belt surface to cause a malleable surface to deform to provide a frictional force sufficient to move the belt forward. Conversely, in example embodiments herein, grit rollers are used to provide a moveable contact surface that will not be prone to stick to label adhesive nor accumulate adhesive residue.

Suitable grit rollers can be formed from metal or rigid plastic. A grit roller is suitably formed by applying an adhesive to a radial surface of a pick tire and then applying a hard, grit substance such as carborundum or tungsten carbide granules which then form the roller surface. A feature of grit rollers is that their surfaces do not compress. Therefore, indexing can be more accurate, such as when roller speed is controlled by use of a stepper motor drive.

Use of a grit roller as a pick roller reduces the contact area of the pick roller so the sticky media is less likely to remain attached to the roller. Use of a grit roller as a drive roller or its associated idler roller for surfaces contacting an adhesive surface has analogous advantages. At the same time it retains a high coefficient of friction for good pick mechanics.

FIG. 1 is an example embodiment of an inline printer 100 for printing on label stock 104 removed from roll 108. Label stock 104 is liner-less and includes an adhesive side 112 and a non-adhesive side 116. Label stock 104 is removed from roll 108 by cooperation between opposed and counter rotating drive roller 120 and idler roller 124, illustrated in exploded view as drive roller 120' and idler roller 124'. One or both rollers is supplied rotational force from a motor, such as motor 125. Drive roller 120' includes contact surface 128, suitably comprised of a grip or malleable material such as rubber, silicone rubber, or any other suitable grip surface. Idler roller 124' is comprised of a grit roller having grit surface 132, illustrated further in exploded view as grit surface 132' of idler roller 124". Contact surfaces of drive roller 120 and idler roller 124 are biased against one another to grip the label stock 104 for cooperative movement. Drive roller 120 and idler roller 124 receive label stock 104 at a nip 126 disposed between them.

Figure 2:
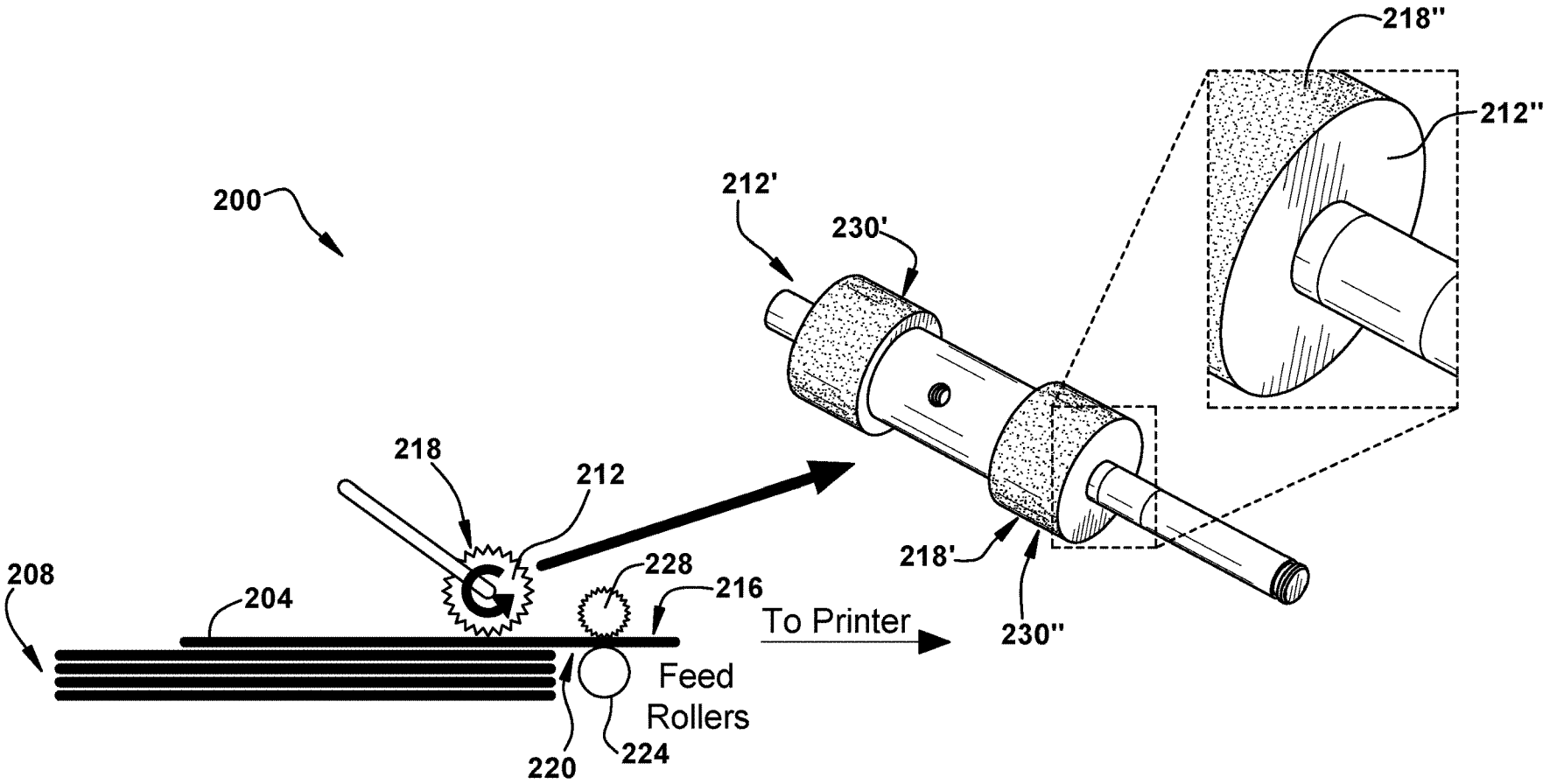
FIG. 2 is an example embodiment of a paper pick system for picking sticky media from a stack for printing.

FIG. 2 illustrates an example embodiment of a paper pick system 200 for picking sticky media from a stack for printing. In the illustrated example, a top sheet 204 of a label stack 208 is removed by pick roller 212 in contact with a top surface. Labels, such as sheet 204, include an adhesive side 216 and a non-adhesive side 220, suitably with a coating that is not conducive to sticking adhesive portions of a next label in label stack 208. Pick roller 212, further illustrated in exploded views as 212' and 212", includes a grit surface 218 configured to contact the top surface of the adhesive side 216 of sheet 204 and to move it to feed rollers 224 and 228. As detailed above, feed roller 228 is also suitably comprised of a grit roller given it contacts adhesive side 216. Pick roller 212 may also include two or more grip surface portions, such as having grip surface 218' configured as first grip portion 230' and second grip portion 230" as shown in exploded view as 212'228.

Figure 3:
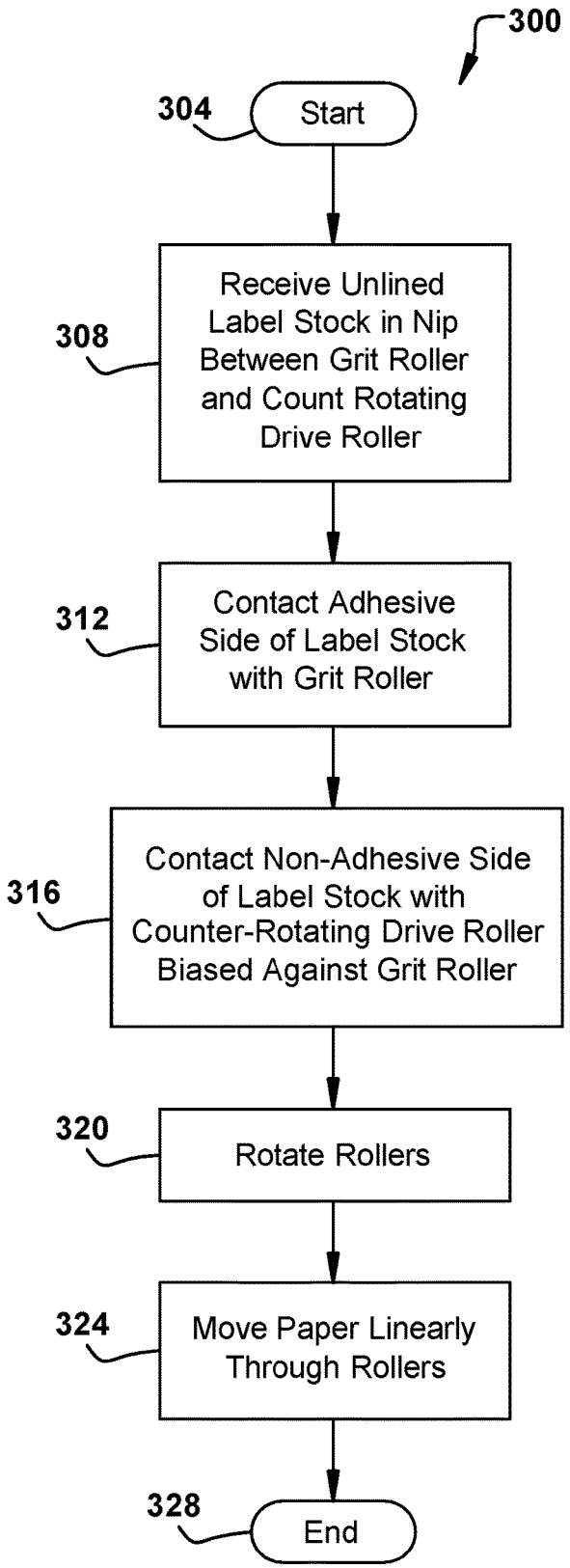
FIG. 3 is a flowchart of an example embodiment of a system for using a grit roller for printing on sticky media.

FIG. 3 is a flowchart of an example embodiment of a system 300 for using a grit roller for printing on sticky media. The process commences at block 304 and proceeds to block 308 where unlined label stock is received in a nip between a grit roller and a counter rotating drive roller. Contact is made between the adhesive side of the label stock and a radial surface of the grit roller at block 312, while contact is made between the non-adhesive side of the label stock at block 314 and a radial surface of the counter rotating drive roller which is biased against the grit roller at block 316. The rollers rotate cooperatively at block 320 to move the label stock linearly at block 324. The process ends at block 324.

Figure 4:
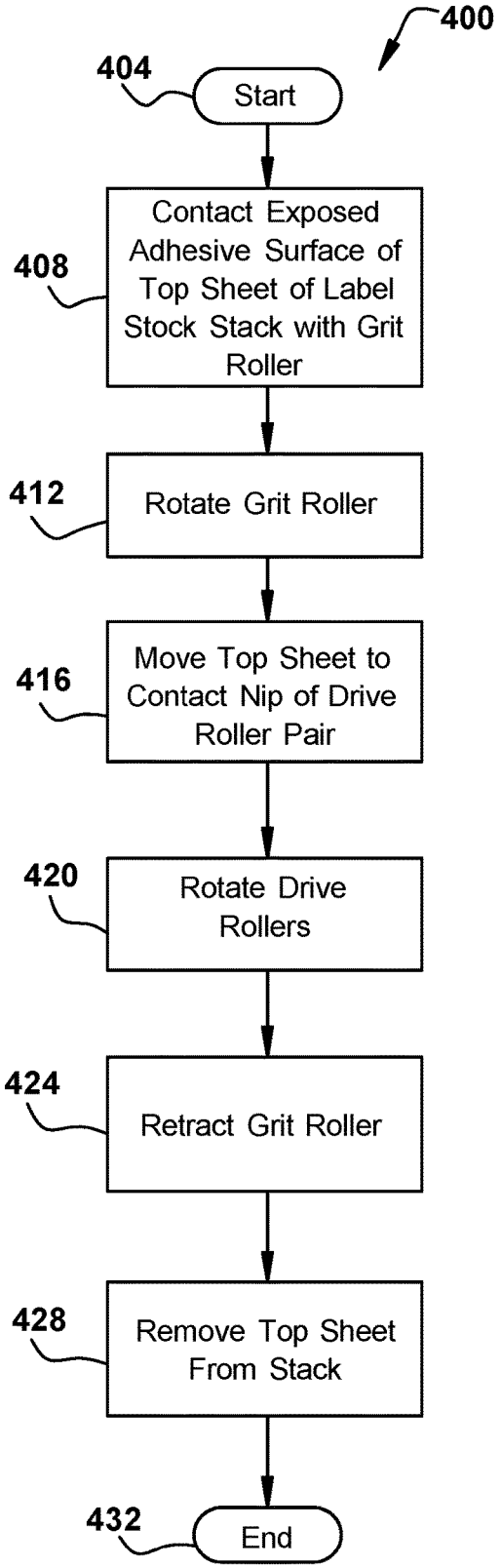
FIG. 4 is a flowchart of an example embodiment of a system for using a grit roller as a pick roller.

FIG. 4 is a flowchart of an example embodiment of a system 400 for using a grit roller as a pick roller. The process commences at block 404 and proceeds to block 408 where a grit roller is moved to contact an exposed adhesive surface of a top sheet of label stock of a stack. The grit roller is rotated at block 416 to move the top sheet to contact a nip of a drive roller pair at block 416. The drive rollers are rotated at block 420 and the grit roller is retracted at block 414. The top sheet is removed from the stack by the drive rollers at block 420 and the process ends at block 432.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the spirit and scope of the inventions.

What is claimed is:

1. A liner-less label stock conveying system comprising:

a pick roller comprised of a grit roller configured to contact an adhesive side of an unlined label stock;

a motor configured to generate a rotational force to cause the grit roller to rotate on an axis thereof;

wherein the unlined label stock is removed from the grit roller and fed to a nip between first and second feed rollers of an associated printer;

wherein the first feed roller has a grit surface configured to contact the adhesive side of the unlined label stock; and wherein the unlined label stock is comprised of a top label from a stack of labels and wherein the pick roller is further configured to contact an adhesive side of a next top label in the stack after the unlined label stock is fed to the nip.

2. The system of claim 1 wherein a surface of the grit roller is comprised of carborundum or tungsten carbide.

3. The system of claim 1 wherein a surface of the second feed roller is malleable.

4. The system of claim 3 wherein the surface of the surface of the second feed roller is comprised of rubber.

5. The system of claim 4 wherein the surface of the second feed roller is comprised of silicone rubber.

6. A method of conveying liner-less label stock for printing comprising:

contacting an adhesive side of an unlined label stock received from an associated roll thereof with a surface of a pick roller comprised of a grit roller;

generating a rotational force to cause the grit roller to rotate on an axis thereof;

wherein the unlined label stock is removed from the grit roller and fed to a nip between first and second feed rollers of an associated printer; and wherein the first feed roller has a grit surface configured to contact the adhesive side of the unlined label stock.

* * * * *